US010625109B1

(12) United States Patent
Bytella

(10) Patent No.: US 10,625,109 B1
(45) Date of Patent: Apr. 21, 2020

(54) ISOTONIC/ISOMETRIC PORTABLE/WEARABLE EXERCISER WITH MOVABLE/ROTATABLE STRAPS AND EXERCISE METHOD

(71) Applicant: Joseph J. Bytella, Catonsville, MD (US)

(72) Inventor: Joseph J. Bytella, Catonsville, MD (US)

( * ) Notice: Subject to any disclaimer, the term of this patent is extended or adjusted under 35 U.S.C. 154(b) by 0 days.

(21) Appl. No.: 16/571,019

(22) Filed: Sep. 13, 2019

(51) Int. Cl.
*A63B 21/002* (2006.01)
*A63B 21/00* (2006.01)
*A63B 23/035* (2006.01)

(52) U.S. Cl.
CPC .... *A63B 21/0023* (2013.01); *A63B 21/00185* (2013.01); *A63B 21/4013* (2015.10);
(Continued)

(58) Field of Classification Search
CPC ..... A63B 21/0004; A63B 21/00185; A63B 21/002; A63B 21/0023; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/4011; A63B 21/4013; A63B 21/4015; A63B 21/4017; A63B 21/4019; A63B 21/4021; A63B 21/4023; A63B 21/4025; A63B 21/4027; A63B 21/4033; A63B 21/4035; A63B 21/4039; A63B 21/4041; A63B 21/4043;
(Continued)

(56) References Cited

U.S. PATENT DOCUMENTS 2,498,006 A * 2/1950 Ridill ..... A63B 69/0059 473/217
2,994,300 A * 8/1961 Grahling ..... A01K 27/005 119/770

(Continued)

FOREIGN PATENT DOCUMENTS

EP 2764896 A1 8/2014
WO 9808570 A1 3/1998

OTHER PUBLICATIONS

Physiopedia, Cardinal Planes and Axes of Motion, [online], [retrieved on Sep. 25, 2019]. Retrieved from the Internet <URL: https://www.physio-pedia.com/Cardinal_Planes_and_Axes_of_Movement.].

*Primary Examiner* — Gary D Urbiel Goldner
(74) *Attorney, Agent, or Firm* — Capitol City TechLaw, PLLC; Samuel P. Burkholder

(57) ABSTRACT

An exerciser that is discreet, portable, wearable, and easy-to-install and remove is presented. It is designed to custom-fit to the body for isometric and isotonic exercises to strengthen and develop the upper torso and leg muscles through resistive movement of opposing muscle groups. One example of the exerciser consists of support and grip straps and 360° swivel. The support strap is a loop that is fastened to either or both wrists, arms, legs, or ankles with a buckle or equivalent closure, and designed to form fit to the appendages with ½-inch spaced holes. The grip strap is a continuous loop used as a grip for the hands. The exerciser can facilitate many range-of-motion exercises in the frontal, sagittal and transverse planes.

8 Claims, 13 Drawing Sheets

(52) U.S. Cl.
CPC ..... *A63B 21/4015* (2015.10); *A63B 21/4019* (2015.10); *A63B 21/4021* (2015.10); *A63B 21/4035* (2015.10); *A63B 23/0355* (2013.01)

(58) Field of Classification Search
CPC ..... A63B 21/4045; A63B 21/4047; A63B 21/4049; A63B 23/035; A63B 23/03516; A63B 23/03533; A63B 23/03541; A63B 23/0355; A63B 23/03575; A63B 23/04; A63B 23/08; A63B 23/10; A63B 23/12; A63B 23/14; A63B 23/16; A63B 69/0057; A63B 69/0059; A63B 2069/0062; A63B 71/0054; A63B 2071/0072; A63B 2225/09
See application file for complete search history.

(56) References Cited

U.S. PATENT DOCUMENTS 3,069,169 A * 12/1962 Topping ..... A63B 69/0059 473/212
4,047,714 A 3/1977 Powell
4,019,734 A 4/1977 Lee et al.
4,079,933 A 3/1978 Everroad
4,141,116 A * 2/1979 Zalonis ..... A01K 91/03 24/375
4,441,707 A 4/1984 Bosch
4,552,356 A 11/1985 Brousseau
4,602,784 A 7/1986 Budden et al.
4,685,671 A 8/1987 Hagerman et al.
5,129,647 A 7/1992 Castellanos
5,328,432 A 7/1994 Gvoich
5,336,151 A 8/1994 Ballegooie
5,505,677 A * 4/1996 Hinds ..... A63B 21/0004 482/10
5,518,486 A 5/1996 Sheeler
5,580,336 A 12/1996 Coallier
5,628,714 A 5/1997 Philipson
5,683,336 A 11/1997 Pape
5,711,747 A 1/1998 Steinback
5,718,640 A * 2/1998 Noblin ..... A63B 69/0059 473/212
5,735,781 A 4/1998 Pai
5,776,083 A 7/1998 Jacob et al.
5,807,217 A 9/1998 Endelman
5,902,189 A * 5/1999 Schultz ..... A63B 69/0059 473/212
6,117,056 A 9/2000 Cataldi, Jr. et al.
6,190,291 B1 2/2001 Schwarz
6,540,651 B1 4/2003 Aberton et al.
7,137,935 B2 11/2006 Clarke et al.
7,727,131 B2 6/2010 Longo
7,819,789 B2 10/2010 Berman et al.
7,850,578 B2 12/2010 Balaker et al.
8,033,958 B2 10/2011 Beyzavi-Armani
8,123,661 B2 2/2012 Beyzavi-Armani
8,403,817 B2 3/2013 Ferguson et al.
8,944,976 B2 2/2015 Crowell et al.
8,961,376 B2 2/2015 Sweeney et al.
9,005,090 B2 4/2015 Latronica
9,039,574 B2 5/2015 Wilson
9,061,177 B1 6/2015 Singh
9,259,605 B1 2/2016 Puig et al.
9,333,398 B1 * 5/2016 Schlapik ..... A63B 67/08
9,656,115 B2 5/2017 Young
2010/0016132 A1 1/2010 Flynn
2010/0075819 A1 3/2010 Maki
2012/0329618 A1 * 12/2012 White ..... A63B 21/0552 482/126
2012/0329620 A1 * 12/2012 White ..... A63B 21/151 482/131
2013/0040791 A1 2/2013 Bornstein
2014/0315666 A1 * 10/2014 Medley ..... A63B 69/0059 473/450
2015/0367159 A1 * 12/2015 Harris ..... A63B 21/0557 482/122
2017/0274236 A1 9/2017 Farias

* cited by examiner

ISOTONIC/ISOMETRIC PORTABLE/WEARABLE EXERCISER WITH MOVABLE/ROTATABLE STRAPS AND EXERCISE METHOD

BACKGROUND OF THE INVENTION

Field of the Invention

This present invention relates to exercise devices that are simplistic in design and with few components, and are discreet, low impact, compact, portable, and wearable, for use in resistive isotonic and isometric exercises for sports conditioning, muscle development and physical rehabilitation of all major upper body and leg muscles. Such devices are designed for multi-planar exercises in lying, sitting, and standing positions.

Description of the Related Art

Human exercise motion can be defined in three dimensions by planes that dissect the body, the sagittal, frontal, and transverse planes, and axes of motion in these planes. The sagittal plane is vertical to the body and divides it in right and left halves. Examples of exercises in sagittal axis of motion are biceps curls and squats. The frontal plane is vertical to the body and divides it in front (anterior) and back (anterior) halves. Examples of exercises in the frontal axis of motion are star jumps, side bending, and lateral arms raises. The transverse plane is horizontal to the body, divides it at the midsection into top and bottom halves. Examples of exercises in the transverse axis are golf swinging or baseball throwing. Full body exercise routines should engage and move the muscles in the axes of motion of all three planes.

Isometric and isotonic are two types of resistance exercises. Isometric exercises are where the body muscle(s) remains still against a static force, and in isotonic resistance exercises the body muscles move against a resistance force. A combination of isometric and isotonic resistive exercises is used to condition and strengthen the major upper body and leg muscles.

Some isotonic resistance exercise techniques use free weights or exercise equipment with weights or bands (elastic or inelastic) that are bulky and expensive. Moreover, the exercise weights and machines may require maintenance or repair, and can cause muscle strain or bodily injury from over use or misuse. These exercise devices or their equivalents are heavy, not portable, and unwearable for discreet office or home exercise routines.

Pape U.S. Pat. No. 5,683,336, issued on Nov. 4, 1997, discloses an exercise device with arm and leg harnesses connected by resistance (elastic, spring or hydraulic) arms, worn by the user on the upper body or legs.

Steinback U.S. Pat. No. 5,711,747, issued on Jan. 27, 1998, discloses the invention for an elastic exercise bands and cuffs secured to the wrists and limbs with VELCRO® style fasteners. Movement of the muscles in the wrists and limbs creates a resistive force, with varying amounts of tension, to condition the muscles of the upper and lower body.

U.S. Pat. No. 6,117,056 to Cataldi, et al., issued on Sep. 12, 2000, discloses the invention of an isotonic exercise device that attaches to the seat of a chair. The device includes a strap for the seat of the chair and elastic bands that attach to the legs and arms with straps that apply resistive forces to the muscles of the torso and legs for isotonic exercises.

Schwarz U.S. Pat. No. 6,190,291, issued on Feb. 20, 2001, discloses a fitness method combining isometric and isotonic exercises using only the exerciser's hands. Coupling the hands and push-pull movements of the hands, together in various configurations, generates isometric-like resistive forces that can be coupled with body movements to generate isotonic-like exercises.

U.S. Pat. No. 6,540,651 issued to Aberton, et al., issued on Apr. 1, 2003, discloses an exercise apparatus and methods for exercising body parts and appendages. The user places sleeves, stockings or headbands over the appropriate parts of the body then fixed anchors are attached. Elastomer tubing is attached to the anchors and the other end of the tubing wedged between a door and a doorjamb for isometric-like and isotonic-like resistance exercises.

U.S. Pat. No. 7,137,935, issued to Clarke on Nov. 21, 2006, discloses the invention of an office gym portable exercise kit. The kit includes a flexible body that is wrapped around the chair post and under the base and flexible band wrapped around the back of the chair. The flexible band and body have retainers to which elastic straps are attached. Extension of the straps with the arms and legs exert resistances forces on the limbs for isotonic exercises.

U.S. Pat. No. 7,727,131, issued to Brett on Jun. 1, 2010 discloses a linked stretch tubing exercise system and method. This invention is a linked stretchable tubing device with a second tubing attached or linked to the first tubing. The device loop can be attached to a waist harness, and the other tubing loop attached to the users arm or foot or a door anchor. The loops can also be attached directly to a door anchor, and the other loop attached to the user's arms or legs to facilitate isotonic-like exercises.

Sweeney, et al., in U.S. Pat. No. 8,961,376 discloses an apparatus and method to stretch upper and lower extremities. This invention is an arm or leg stretching apparatus with a custom-fit wrist or ankle cuff connected to a steel cable. The other end of the cable is anchored to a sturdy object, e.g. pole, post or wall. The invention also claims a waist belt that can be anchored to a pole, wall, or post, etc.

United States Patent Application No. 2017/0274235 by Farias, published on Sep. 28, 2017, discloses a belt-like resistance strap where the ends can be attached to exercise equipment. This one strap allows the user to utilize multiple exercise equipment (or weights) and different strap resistance to facilitate isometric and isotonic exercises.

Pulg, et al., in U.S. Pat. No. 9,259,605, issued on Feb. 16, 2016, discloses an exercise device that includes an inelastic exercise strap assembly with grip strap and heal or foot strap. The straps define the exercise planes of motion, and therefore limit full body resistance exercise.

U.S. Pat. No. 9,656,115, issued to Young on May 23, 2017, discloses an exercise device including elastic closed loop resistance tension band. The continuous elastic loop has at least one hand grip and a foot cradle. The device provides for total body isometric and isotonic exercises.

The above-cited art have harnesses, straps, bands (elastic or inelastic) or anchor points that may shift or break under load (force) during exercise, and potentially result in injury to the joints, tendons, ligaments, or muscles. These inventions are not discreet for office use, but rather are bulky, have large footprints and are slow to attach and detach from the body because of their cables, bands, and anchor device components. The attachment points of the exercise devices to the arms and legs limit their range of motion. The other inventions cited, with wrist or cuff attachments, are inexpensive to manufacture, small and portable, but limited in scope of exercise applications, and therefore, have limited range of exercise positions to engage and exercise all muscles in the upper body torso and leg muscles, or target all major muscle groups. These devices can't facilitate multi-planar exercises in the sagittal, transverse, and frontal exercises required for full body exercises. The exercise devices described in the above-listed references do not facilitate multi-planar full range of exercises, arm curls and extensions, side stretches and leg bends, arm curls with legs, leg sweeps, sit-ups and squats exercises that engage upper body and leg muscles for full body muscle strengthening and development.

SUMMARY OF THE INVENTION

This present invention relates generally to resistive exercise devices that can be worn on the user's body, particularly the either or both wrists, arms, legs and ankles for isometric and isotonic full body exercises. This invention has design simplicity, durability, light weight, and inexpensive to manufacture and can be used discretely for home or office exercise routines to condition and strengthen the user's upper body muscles, for example the muscles in the back, shoulders, chest, abdomen, upper and lower arms, and leg muscles. This device is easy to install and remove and can be used in a standing, sitting or lying positions. The invention has support straps that can custom-fit to either wrist, arm, leg or ankle, and hands can position in the grip straps, that can swivel 360° rotation for full range of motion, for isometric and isotonic resistance exercises in the sagittal, transverse, and frontal planes of the body to strengthen, condition and rehabilitate the upper body and leg muscles.

The present teachings further provide a method of isometric and isotonic exercises including the steps of providing at least one support strap, at least one grip strap, and either a 360° rotatable swivel which rotatably attaches the support strap and the grip strap, or looping the grip strap through the support strap. The support strap is then secured to one of a plurality of locations on a user's body, and the grip strap is gripped with a user's hand. Then by contracting and extending the user's arm, the body can be exercised at the location where the support strap is secured.

Also disclosed herein is a wearable exercise device featuring at least one support strap, at least one grip strap, and a 360° rotatable swivel. The support strap and the grip strap are attached to the rotatable ends of the 360° rotatable swivel to form the wearable exercise device.

BRIEF DESCRIPTION OF THE DRAWINGS

The accompanying drawings, which are included to provide a further understanding of the invention and are incorporated in and constitute a part of this specification, illustrate exemplary non-limiting embodiments of the present teachings and together with the detailed description serve to explain the principles of the invention. Like reference numerals refer to like parts throughout the various views of the drawings. In the drawings.

DETAILED DESCRIPTION OF THE INVENTION

Figure 1:
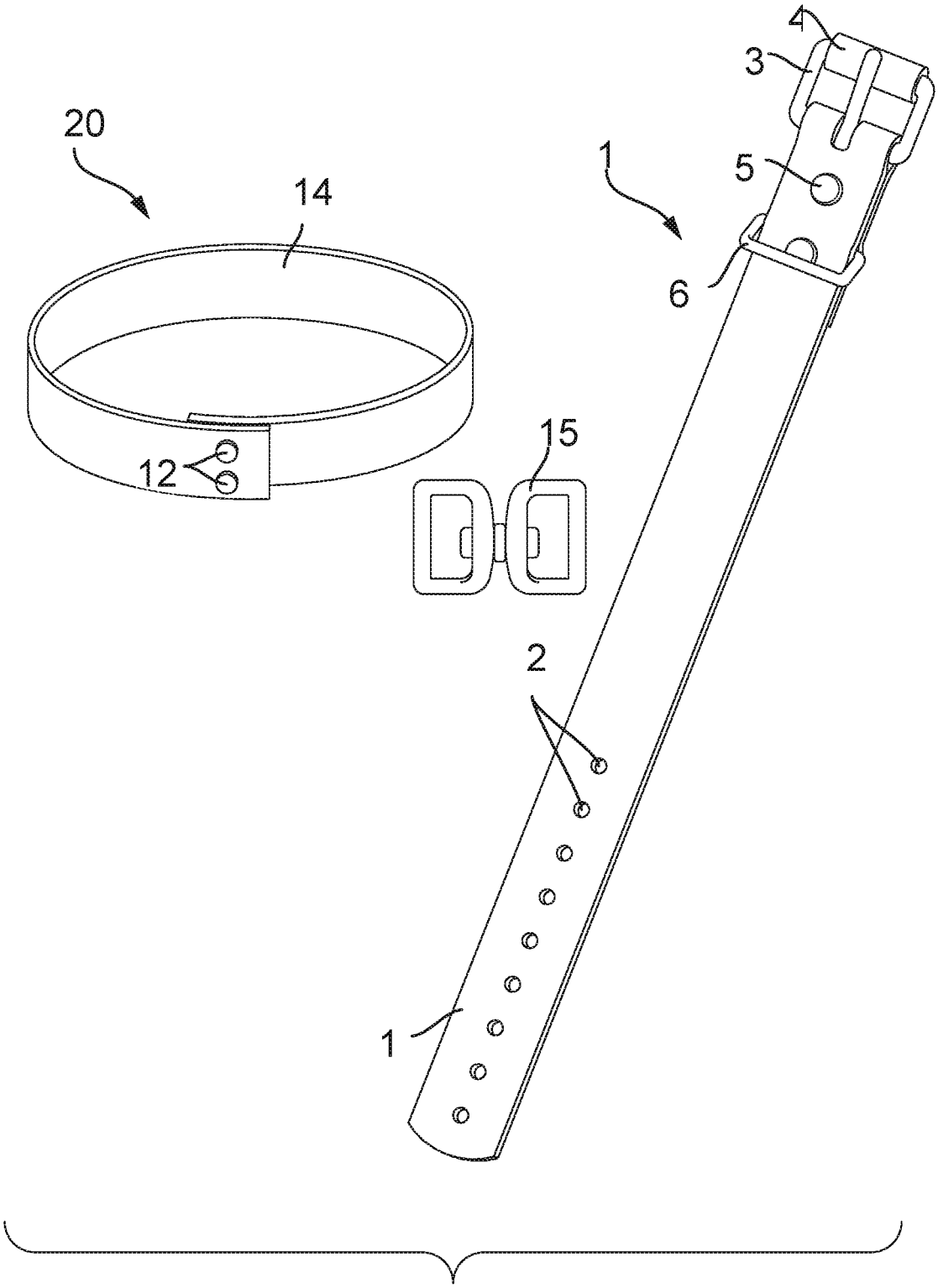
FIG. 1 is an exploded view of an exemplary exercise device embodying the present teachings.
Figure 2:
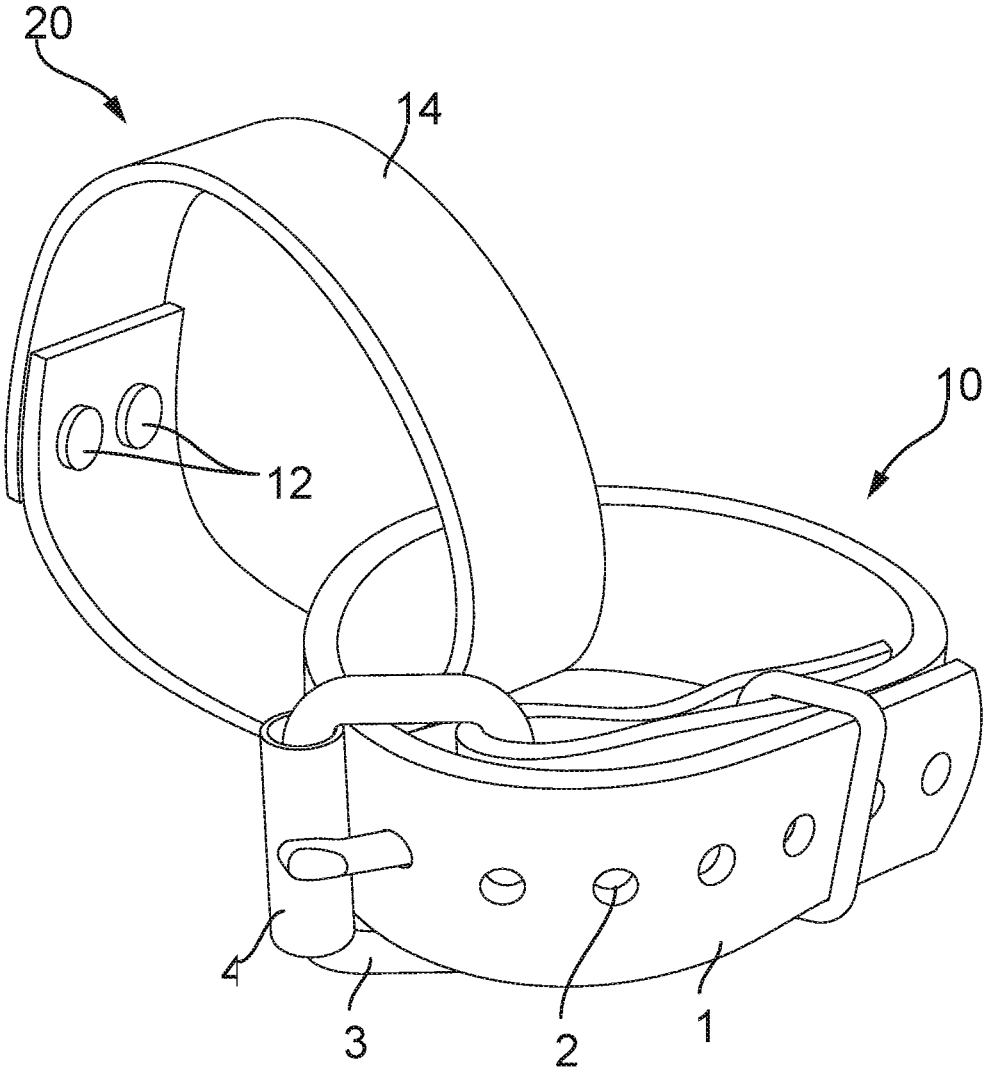
FIG. 2 is a perspective view of an assembled exemplary exercise device embodying the present teachings.
Figure 3:
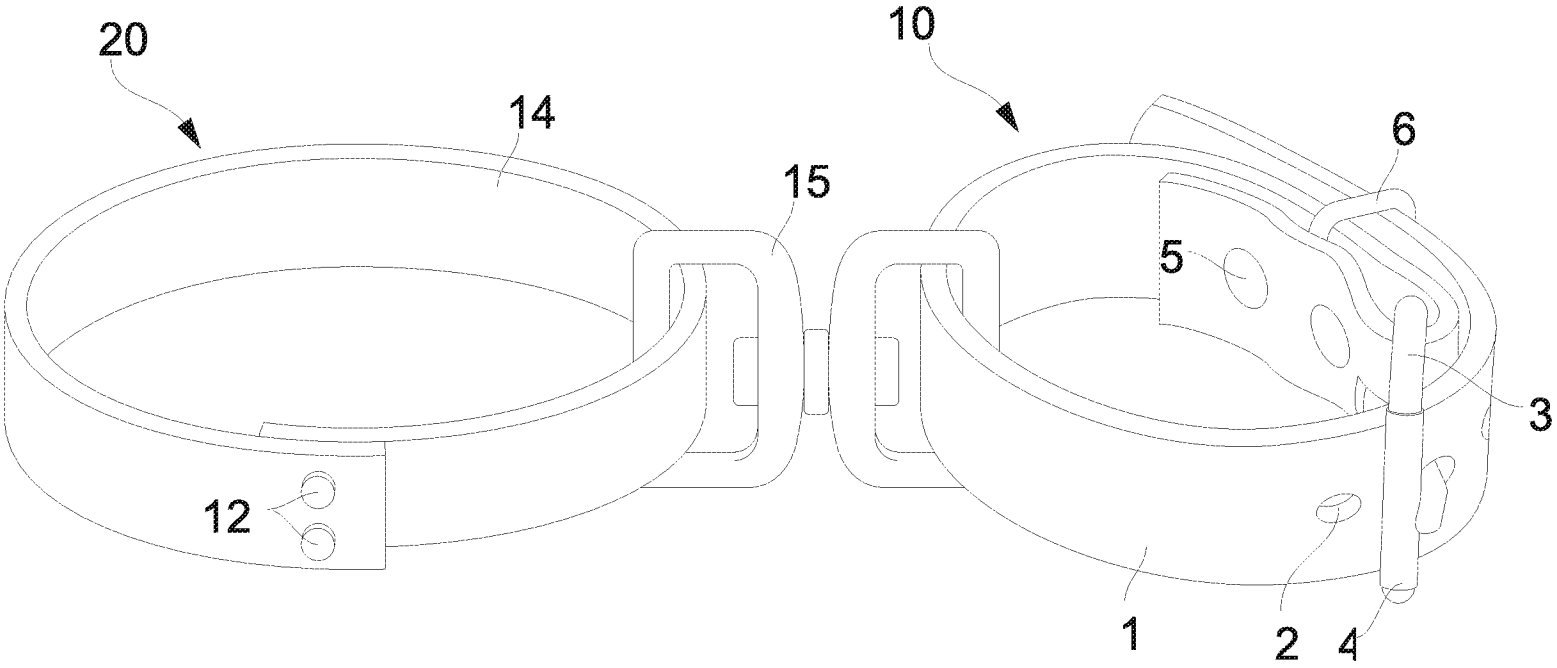
FIG. 3 is a perspective view of an assembled embodiment of the present teachings.

Referring to the drawings of the invention, and components and materials listed in FIG. 1, FIG. 2 and FIG. 3 are, support strap webbing (1), holes (2), buckle (3), roller, (4), support strap rivets (5), loop, (6), support strap (10), square eye swivel 360° (15), grip strap rivets (12), grip strap webbing (14), and grip strap (20).

FIGS. 4 through 13 illustrate the user positions wearing the device illustrated in FIG. 2 in the execution of the exercise routines, where the grip strap (20) is looped through the support strap (10). The device illustrated in FIG. 3 with the square eye swivel 360° (15) connecting the grip strap (20) with the supported strap (10) can also be used for the exercise positions illustrated in FIGS. 4 through 13. However the device in FIG. 3 will allow the 360° rotation of the users hand in the grip strap (20) for greater flexibility of exercise positions compared with the device illustrated in FIG. 2.

Figure 4:
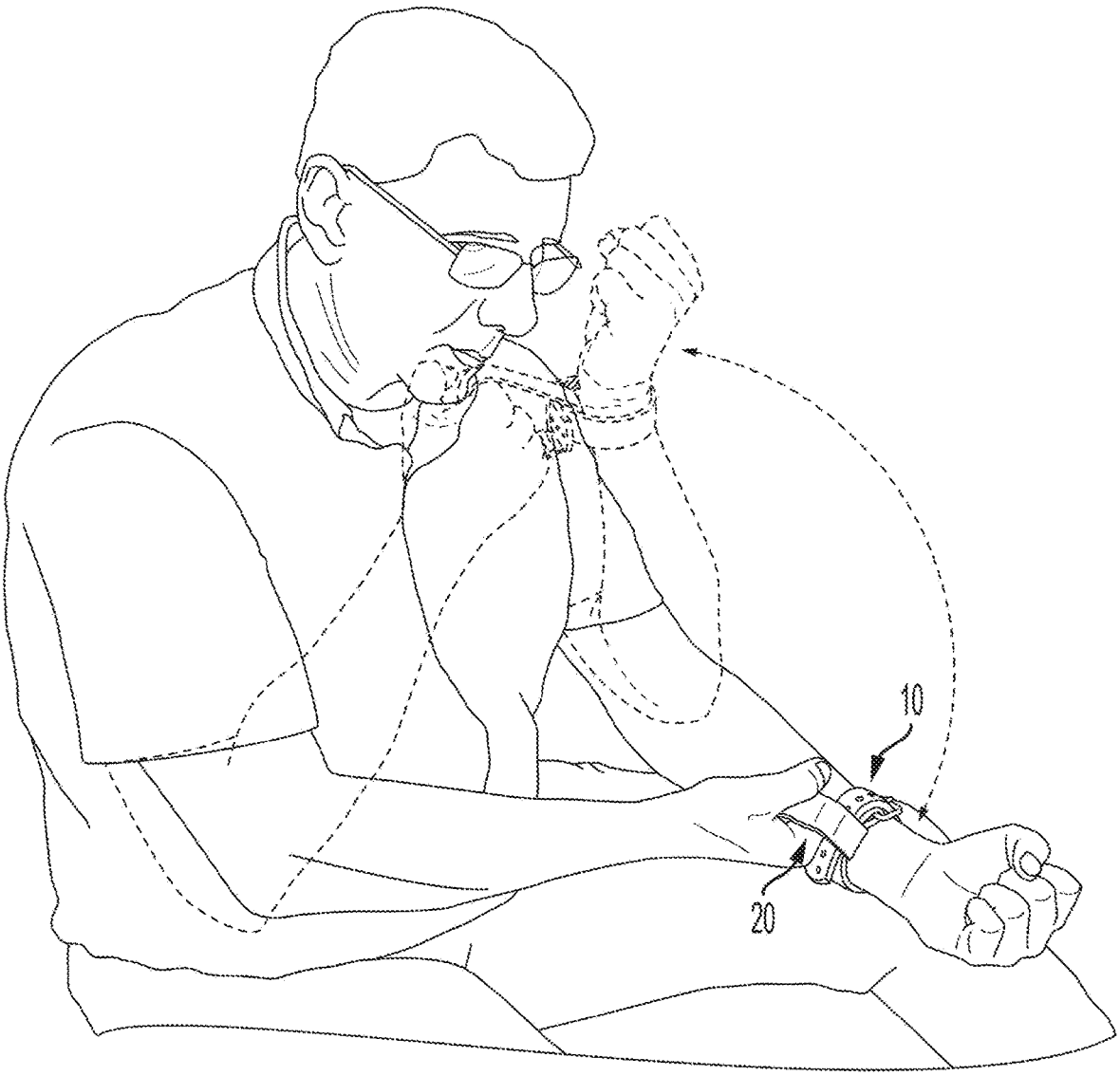
FIG. 4 illustrates a user performing an arm curl exercise with the exemplary device illustrated in either FIG. 2 or 3.

FIG. 4 illustrates a user performing an arm curl exercise with the arm moving toward then away from the body with the device illustrated in either FIG. 2 or 3. Either left or right hand is positioned in the grip strap (20) and support strap (10) is fastened to either wrist of the opposite arm.

Figure 5:
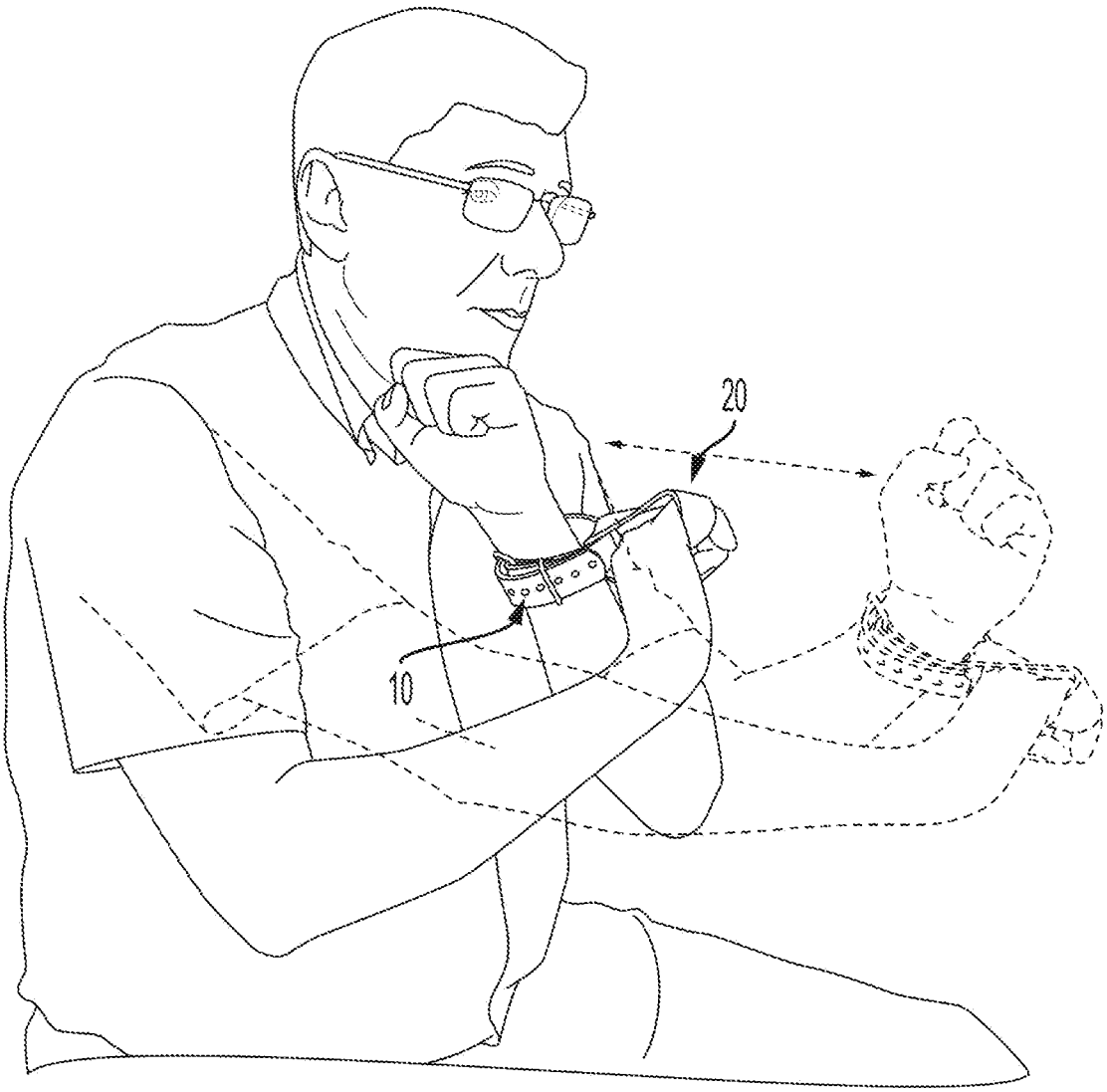
FIG. 5 illustrates a user performing an arm extension exercise with the exemplary device illustrated in either FIG. 2 or 3.

FIG. 5 illustrates a user performing an arm extension exercise with the arm moving away then toward the body with the device illustrated in either FIG. 2 or 3. Either left or right hand is positioned in the grip strap (20) and support strap (10) is fastened to either wrist of the opposite arm.

As set forth above, the device utilized in the exercises illustrated in FIGS. 6 through 13 can optionally include a 360° swivel component as illustrated in the embodiment of FIG. 3. The 360° swivel can be a square eye swivel as illustrated, or can be any suitable 360° swivel component. For instance, the 360° swivel component can be attached in a slideable manner to the grip and support straps, or in a non-slideable manner to the grip and support straps with a suitable fastening device.

Figure 6:
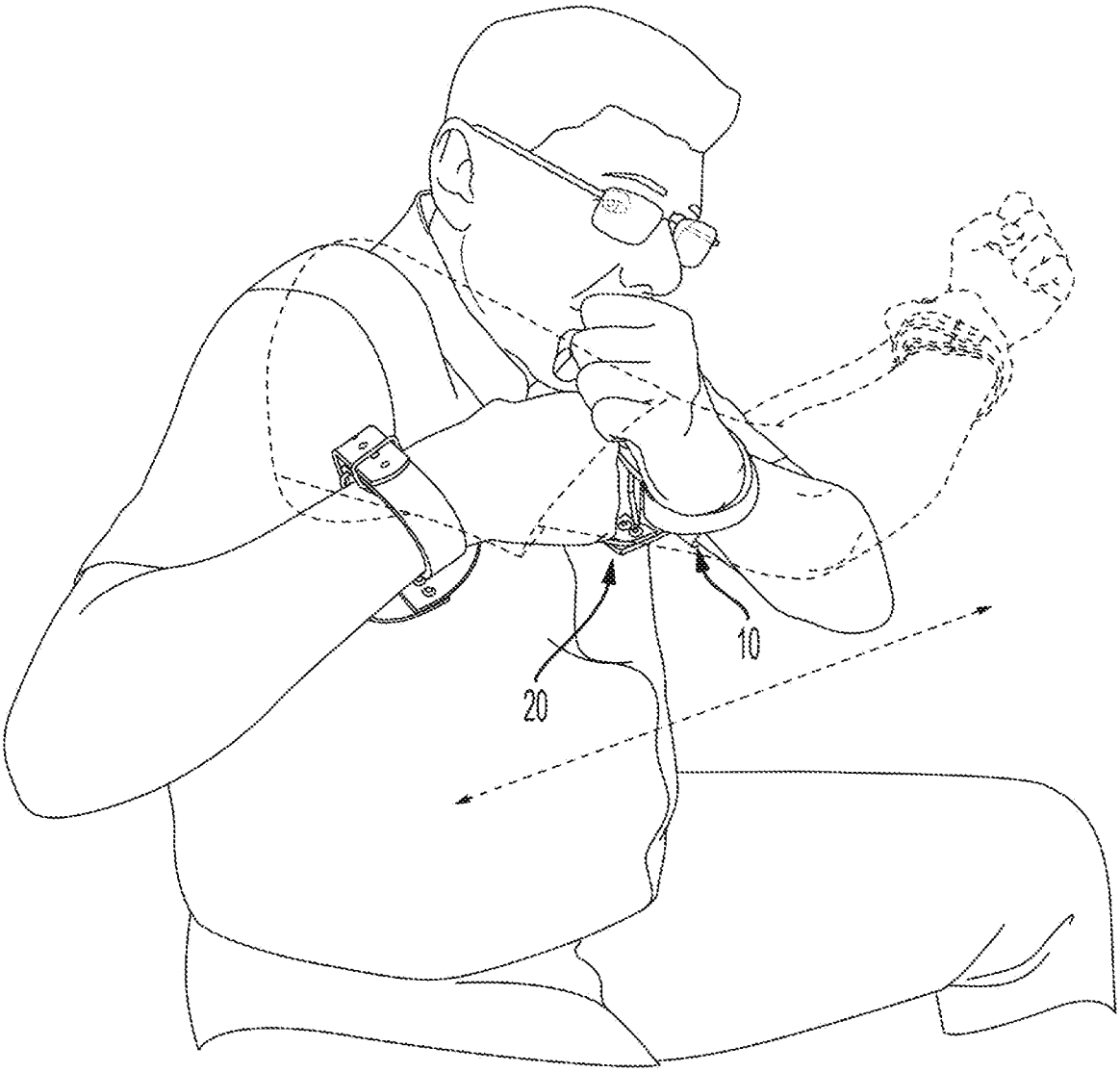
FIG. 6 illustrates a user performing a side stretch exercise with the exemplary device illustrated in either FIG. 2 or 3.

FIG. 6 illustrates a user performing a side stretch exercise with the arms moving across the body from side-to-side in a sweeping motion. Either left or right hand is positioned in the grip strap (20) and support strap (10) is fastened to either wrist of the opposite arm.

Figure 7:
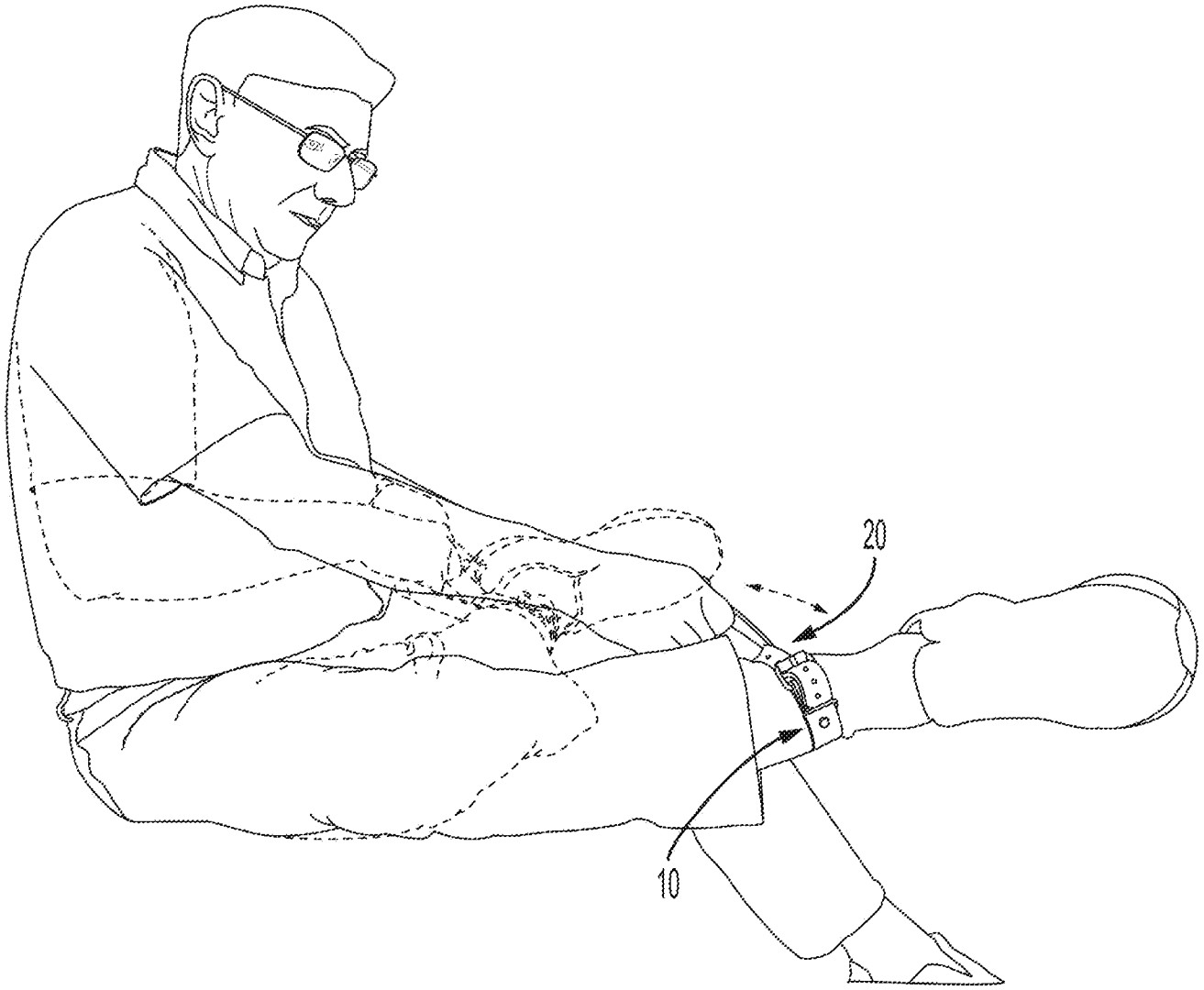
FIG. 7 illustrates a user performing a leg swing or bend exercise with the exemplary device illustrated in either FIG. 2 or 3.

FIG. 7 illustrates a user performing a leg swing or bend exercise with either left or right hand positioned in the grip strap (20) and support strap (10) fastened to either leg ankle. The arm pulls the leg toward then away from the body in a sweeping motion.

Figure 8:
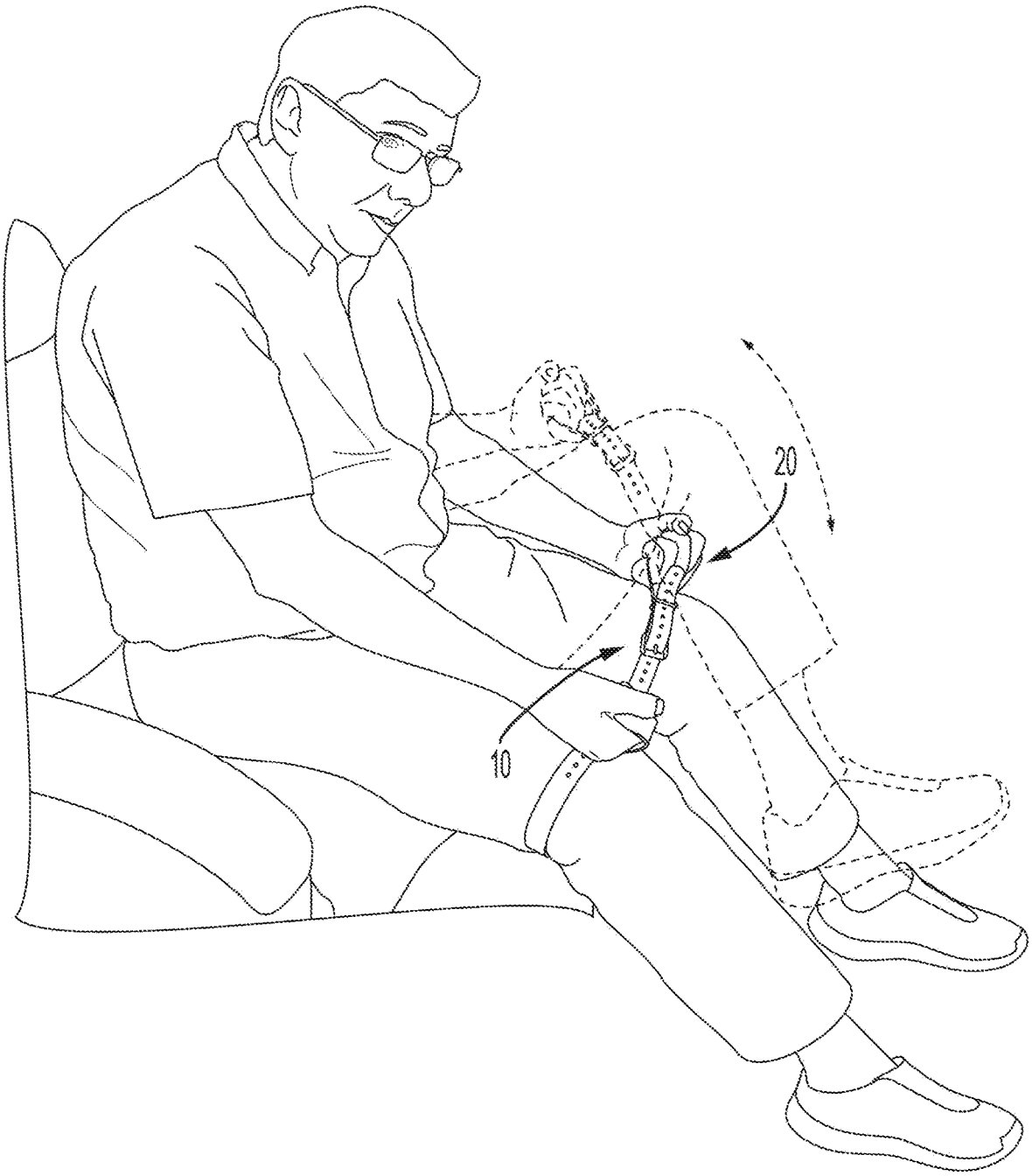
FIG. 8 illustrates a user performing an arm curl with leg exercise with the exemplary device illustrated in either FIG. 2 or 3.

FIG. 8 illustrates a user performing an arm curl exercise with the arm and leg moving toward then away from the body in a sweeping motion. Either left or right hand is positioned in the grip strap (20) and support strap (10) is fastened to the thigh, above the knee, of either leg.

Figure 9:
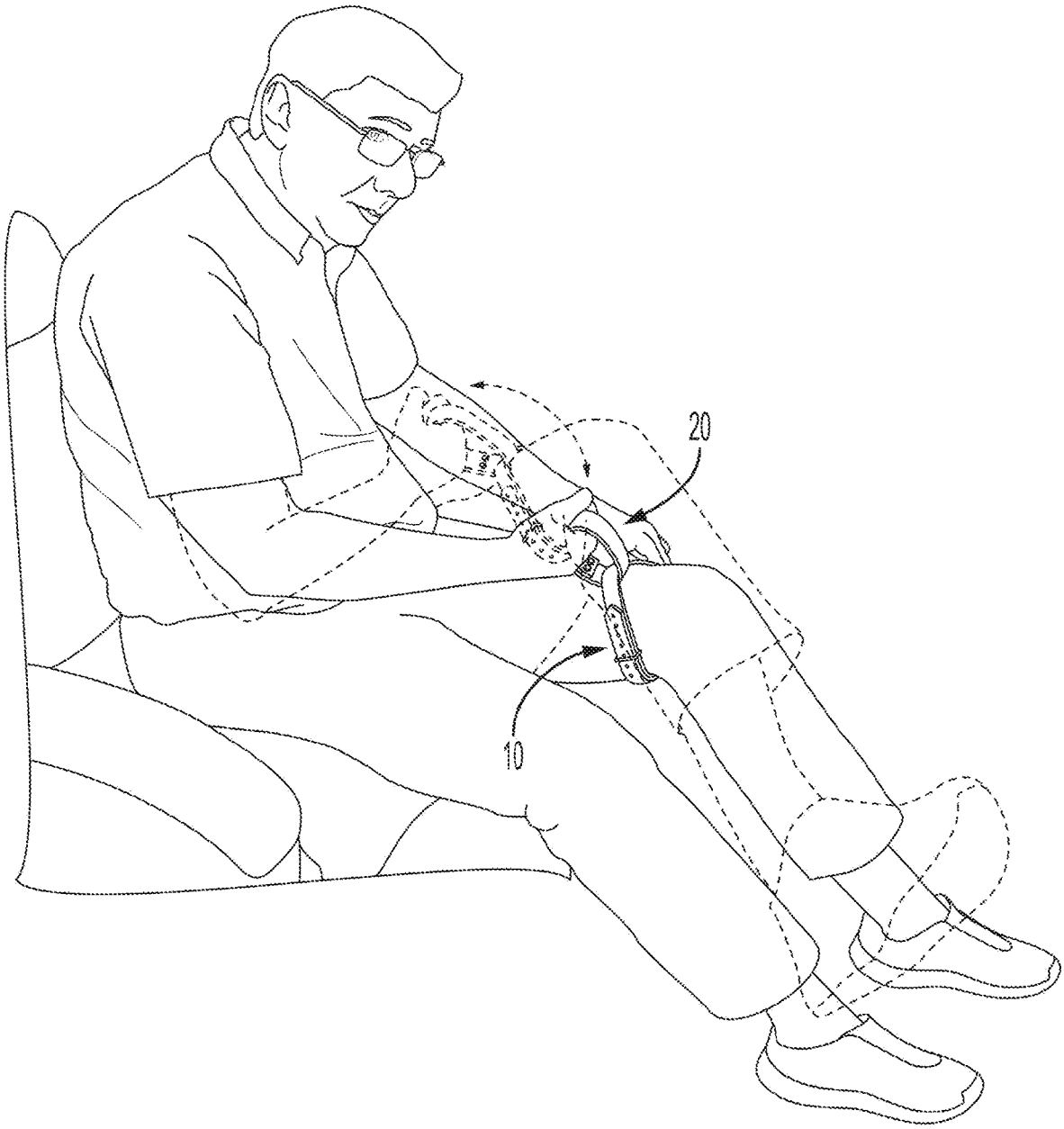
FIG. 9 illustrates a user performing a leg sweep exercise with the exemplary device illustrated in either FIG. 2 or 3.

FIG. 9 illustrates a user performing a leg sweep exercise with either left or right hand positioned in the grip strap (20) and support strap (10) fastened to the thigh, above the knee, of either leg. The hand pulls the leg bends toward then away from the body in a sweeping motion.

Figure 10:
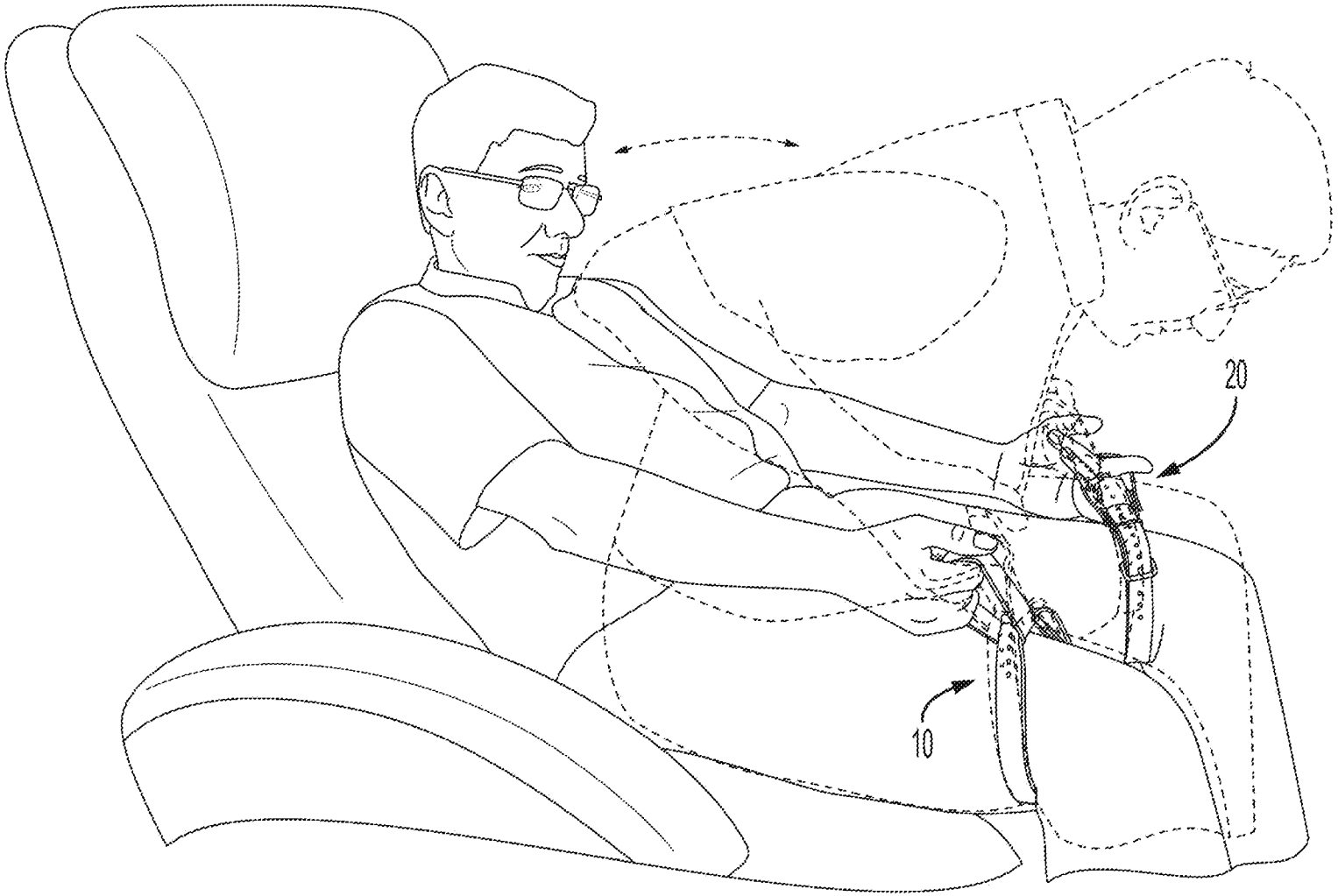
FIG. 10 illustrates a user performing a sit-up exercise in a seated position with the exemplary device illustrated in either FIG. 2 or 3.

FIG. 10 illustrates a user performing a sit-up exercise in a seated position with the both left and right hands positioned in the grip strap (20) and support strap (10) fastened to the upper thighs of both legs. The user pulls the upper body toward the legs then returns to an upright position in a sweeping motion.

Figure 11:
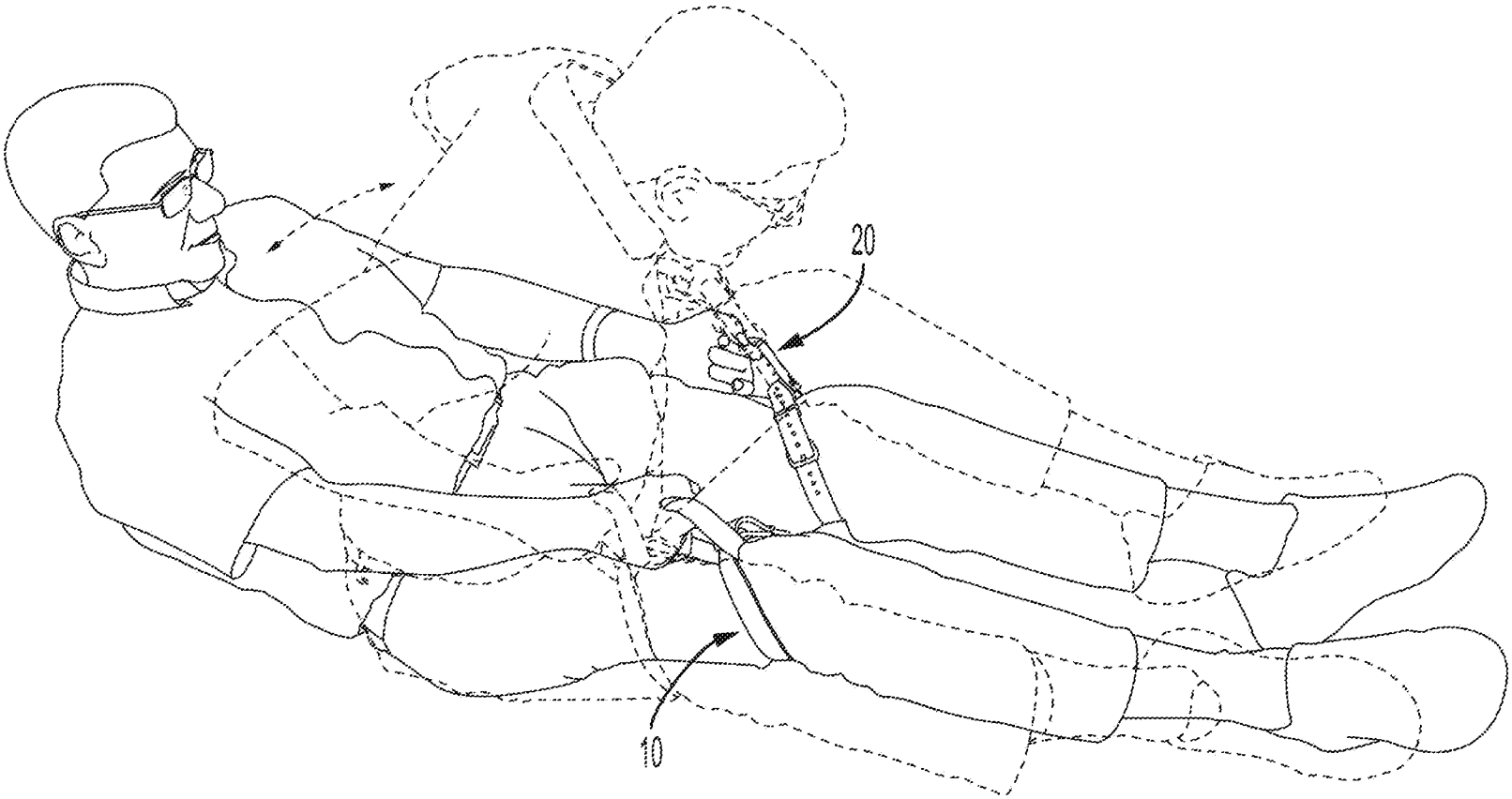
FIG. 11 illustrates a user performing a sit-up exercise on the floor or a flat surface with the exemplary device illustrated in either FIG. 2 or 3.

FIG. 11. illustrates a user performing a sit-up exercise on the floor or a flat surface with the both left and right hands positioned in the grip strap (20) and support strap (10) fastened to the upper thighs, above the knees, of both legs. The user lays with back on the floor and knees slightly bent then pulls the upper body toward the legs then returns to a flat position in a sweeping motion.

Figure 12:
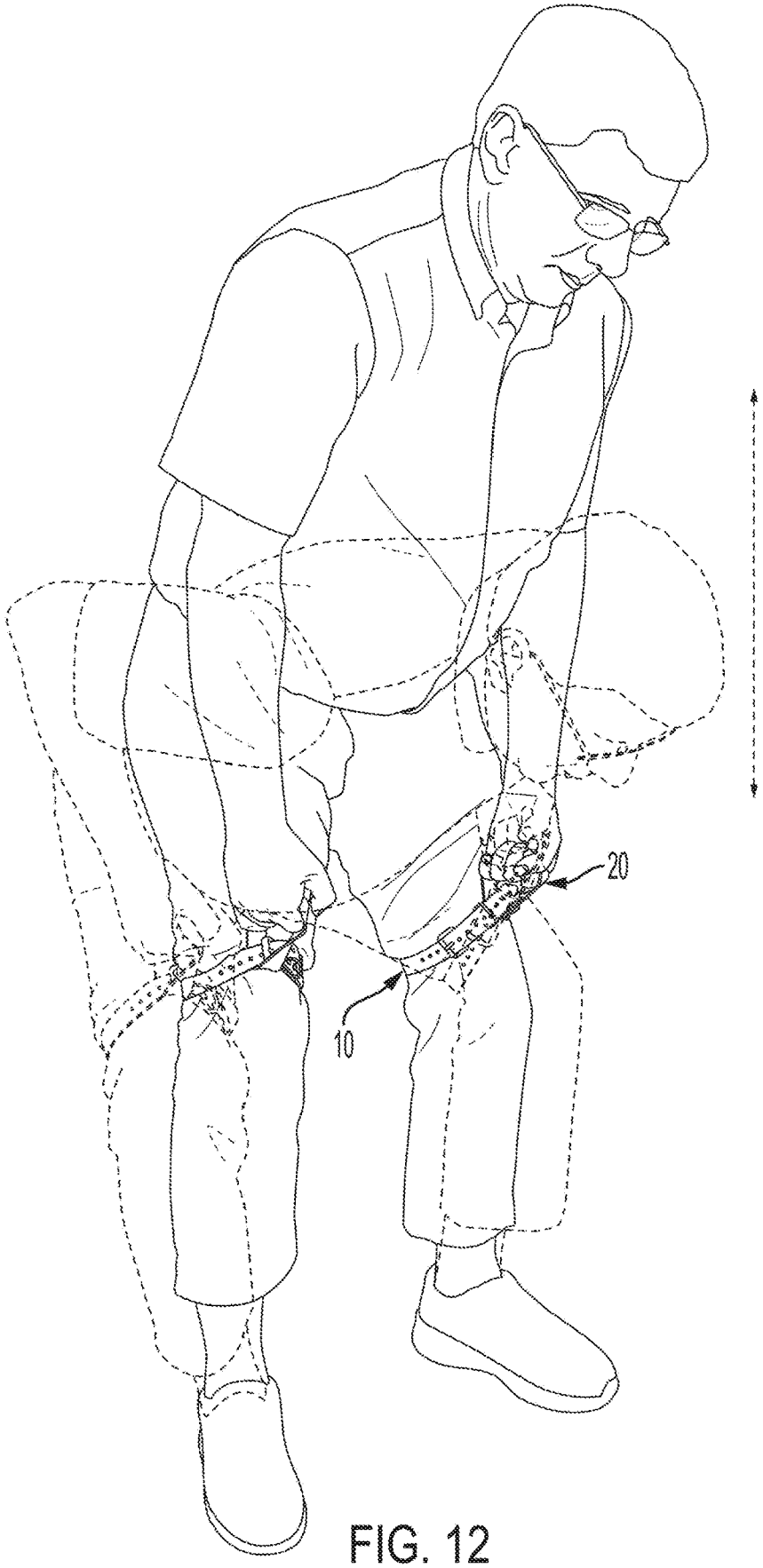
FIG. 12 illustrates a user performing a partial squat exercise with the exemplary device illustrated in either FIG. 2 or 3.

FIG. 12 illustrates a user performing a partial squat exercise with the both left and right hands positioned in the grip straps (20) and support straps (10) fastened to the thighs of both legs, above the knees. The user pulls the upper body toward the legs and bends the torso at the waist then returns the body to an upright position in a sweeping motion.

Figure 13:
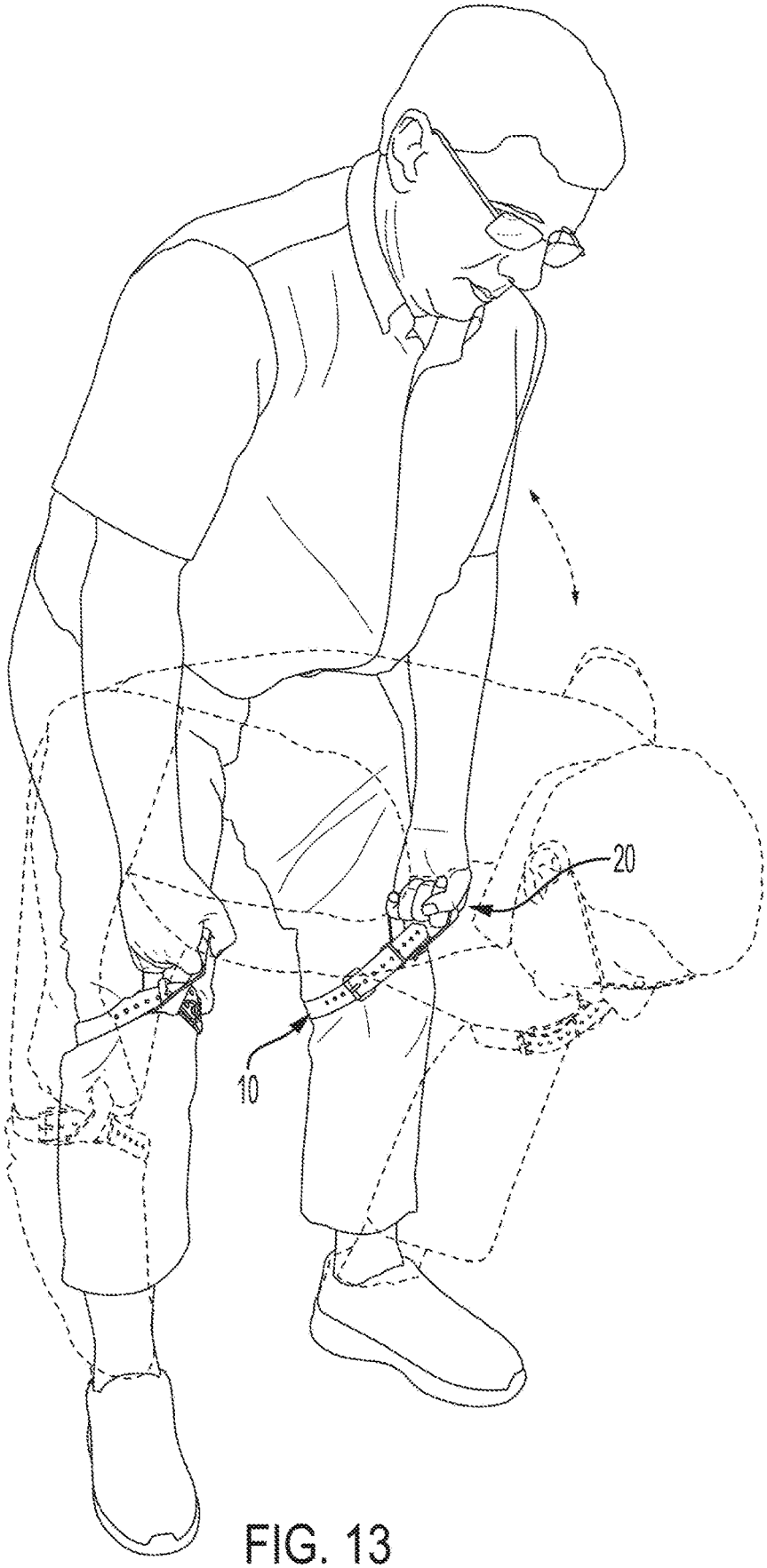
FIG. 13 illustrates a user performing a full squat exercise with the exemplary device illustrated in either FIG. 2 or 3.

FIG. 13 illustrates a user performing a full squat exercise with both left and right hands positioned in the grip straps (20) and support straps (10) fastened to the upper calf, below the knee, of both legs. The user pulls the upper body toward the legs and bends the torso in half then returns the body to an upright position in a sweeping motion.

The method of isometric and isotonic exercises disclosed by the present teachings can be achieved by attaching the support strap to a plurality of locations on a user's body including at least one member selected from the group consisting of hand, wrist, lower arm, upper arm, lower leg, upper leg, ankle, and foot. In some embodiments of the present method, a set of paired support straps and grip straps can be utilized by securing a support strap at the same leg position on both sides of the sagittal plane, and gripping each one of the pairs of grip straps with a user's hand. Then by contracting and extending the user's arm(s) to exercise the user's body at the leg position where the support straps are secured.

These isometric and isotonic exercises can be performed in standing, sitting, or lying positions. Typically, opposing muscle groups are exercised by multiple range of motion isometric and isotonic exercises disclosed herein. Additionally, the upper body and leg muscles can be rehabilitated, developed and strengthened by the isometric and isotonic exercises.

In another embodiment, the present wearable exercise device can include at least one support strap, at least one grip strap, and a 360° rotatable swivel having two rotatable ends. The support strap and the grip strap are attached to the rotatable ends of the 360° rotatable swivel. The support strap can have a buckle or closure, or in other examples have VELCRO® style hook and loop enclosures. The support strap can allow for adjustable closures to custom fit to a user's body. The support strap and the grip strap can be independently composed of any elastic or inelastic, natural or manmade material, such as leather, rubber, polyethylene, polyester, polypropylene, nylon, and elastomers.

Referring back to FIG. 2 in more detail, it illustrates the support strap (10) is looped through and connected to grip strap (20). FIG. 2 and FIG. 3 illustrate the support strap (10) fastened with support strap rivets (5) to secure the buckle (3), roller (4) and loop (6), and fastened to holes (2) to close the support strap webbing (1). FIG. 2 illustrates the grip strap (20) is fastened through the grip strip webbing (14) with grip strap rivets (12) to secure the grip strap (20). FIG. 3 illustrates the support strap (10) connected to the grip strap (20) with the square eye swivel (15).

The construction details of the invention as shown in FIG. 1, FIG. 2, and FIG. 3 in where the support strap webbing (1) and grip strap webbing (14) can independently range from 2.0 inches to 60.0 inches long, 0.25 inches to 5.0 inches wide, and 0.10 to 2.0 inches thick. The support strap can be long enough to be secured around the body part of interest. In some embodiments of the present support straps, the length, width and thickness can be greater than the dimensions given above in order to accommodate larger body sizes and body parts. These webbing components can be manufactured independently of a variety of flexible and durable materials like leather, rubber, or many other natural materials, or polyethylene, polyester, polypropylene, nylon, elastomers, or many other man-made materials. Preferably, webbing components will have the same or nearly the same breaking strength. The buckle (3), loop (6), roller (4), support strap rivets (5), grip strap rivets (12) and square eye swivel (15) can be manufactured of hard and durable materials like hard plastics or metals like brass, copper, stainless steel, or many other hard metals. These fastening components can vary in size to provide the necessary fastening strength to allow the exercises described herein and otherwise to be performed. The size of the fastening components will depend on the size and material composition of the strap webbing material.

Other embodiments or modifications and additions to the current teachings are anticipated without deviating from the scope of the present teachings. The embodiments include stitching, gluing, zippers, clasps, hooks, loops, fasteners, buttons, Velcro® or equivalent closures, to replace the buckles and rivets, are contemplated here. Embodiments of durable webbing components for the grip and support straps include rubber or elastomeric (stretchable) materials to create greater resistance forces for isotonic exercises, or the grip and support straps connected by springs or elastomeric materials or their equivalent for greater resistance forces for isotonic exercises. Rubber, latex, elastic, wool or equivalent soft natural and man-made materials are embodiments of backing materials for the grip and support straps, to prevent irritation or abrasion of the skin contact areas of the arms and legs.

FIG. 4 through 13 illustrate the many exercises, the positions of the support and grip straps on the arms, legs and ankles, and the utility of the grip strap 360° range of motion on the support strap on these appendages. This unique design feature of the invention will afford the user with frontal, sagittal and transverse planes of motion isotonic and isometric exercises, as illustrated in FIG. 4 through 13.

These illustrated exercises are explained in greater detail with the muscle groups utilized in parenthesis, and the user positions.

ARM CURLS (Muscles in the arm, biceps and triceps):

The support strap is secured to the wrist of the left arm, and the right hand is positioned in the grip strap, as illustrated in FIG. 4. The biceps of the left arm contracts in an upward motion while the right arm pushes downward to generate resistance, as illustrated in FIG. 4. The support straps can be attached to either the left or right arms, and left or right hands positioned in the grip straps. The grip strap positioned on the wrist strap can rotate 360° with the square eye swivel for multiple range of motion arm curl exercise positions in the sagittal and frontal planes. The user can be sitting, standing or lying for this exercise.

ARM EXTENSIONS (Muscles in the arm, biceps and triceps. Pectoralis muscles in the chest, and deltoid muscle in the shoulder)

The support strap is secured to the wrist of the left arm, and the right hand is positioned in the grip strap, as illustrated in FIG. 5. The right arm pushes away from the body while the left arm pulls toward the body to generate resistance, as illustrated in FIG. 5. The support straps can be attached to either the left or right arms, and left or right hands positioned in the grip straps. The grip strap positioned on the wrist strap can rotate 360° with the square eye swivel for multiple range of motion arm extension exercise positions in the sagittal plane. The user can be sitting, standing or lying for this exercise.

ARM SIDE-TO-SIDE STRETCHES (Muscles in the arm, biceps, and triceps. Pectoralis muscles in the chest, and deltoid muscle in the shoulder):

The support strap is secured to the wrist of the left arm and the right hand is positioned in the grip strap. The arms are held in front of the body and perpendicular to it, as illustrated in FIG. 6. The arms move side-to-side in a push-pull transverse plane motion using the muscles of the biceps and triceps of both arms to generate resistance, as illustrated in FIG. 6. The grip strap positioned on the support strap can rotate 360° with the square eye swivel for multiple range of motion arm side-to-side exercises positions in the transverse plane. The support straps can be attached to either the left or right arms, and left or right hands positioned in the grip straps. The user can be sitting, standing or lying for this exercise.

LEG SWING OR BEND (Major muscles in the front of the thigh, quadriceps, and the adductors muscles on the inside of the thigh. Biceps and triceps of the arms):

The support strap is secured on the ankle of the right leg and the right hand positioned in the grip strap, as illustrated in FIG. 7. The right arm bicep contracts to pull the leg toward the body, and the leg pushes away from the body, in a push-pull transverse motion to generate resistance, as illustrated in FIG. 7. The grip strap positioned on the support strap can rotate 360° with the square eye swivel for multiple range of motion leg swing or bend exercises positions in the transverse plane. The support straps can be attached to either the left or right ankles, and left or right hands positioned in the grip straps. The user can be sitting in a chair or on the floor to perform these exercises.

ARM CURLS WITH LEG (Muscles in the arm, biceps and triceps and major muscles of the thigh, quadriceps):

The support strap is secured to the left leg, just above the knee, and the left hand positioned in the grip strap, as illustrated in FIG. 8. The left arm bicep is contracted while the left leg pushes away from the body to create push-pull resistance, as illustrated in FIG. 8. The support straps can be attached to either the left or right legs, and left or right hands positioned in the grip straps. The grip strap positioned on the support strap can rotate 360° with the square eye swivel for multiple range of motion arm curl with leg exercise positions in the sagittal plane. The user can be sitting in a chair or on the floor to perform these exercises.

LEG SWEEP WITH ARM (Muscles in the arm, biceps and triceps and major muscles of the thigh, quadriceps):

The support strap is secured to the left leg, just above the knee, and the right hand positioned in the grip strap, as illustrated in FIG. 9. The right arm bicep is contracted while the left leg pushes down to create push-pull resistance, as illustrated in FIG. 9. The support strap can be attached to right leg, and left hand positioned in the grip strap. The grip strap positioned on the support strap can rotate 360° with the square eye swivel for multiple range of motion arm curl with leg exercise positions in the transverse plane. The user can be sitting in a chair or on the floor to perform these exercises.

The exercises depicted in FIGS. 10-13 utilize two sets of straps, a support strap is secured to each leg and a grip strap is looped through each support strap as illustrated. In other embodiments of the present disclosure, the support strap and the grip strap are connected to one another with a swivel component.

SIT-UP FROM CHAIR (Muscles in the arm, biceps and triceps and abdominal muscles):

Support straps are secured on both legs, above the knees, with the grip straps looped inside, and the hands are positioned in the grip straps, as illustrated in FIG. 10. The user is seated on a chair with the legs bent at 90°. The user pulls the upper torso toward the knees to perform the sit-up then returns to an upright position, as illustrated in FIG. 10. The grip strap positioned on the support strap can rotate 360° with the square eye swivel for multiple hand positions and ranges of motion exercise positions in the sagittal plane.

SIT-UP FROM FLOOR (Muscles in the arm, biceps and triceps and abdominal muscles):

The support straps are secured on both legs, above the knees, with the grip straps looped inside, and both hands positioned in the grip straps, as illustrated in FIG. 11. The user is lying on the floor with the head raised and the legs bent at the knees. The user pulls the upper torso toward the knees to perform the sit-up then returns to a prone position, as illustrated in FIG. 11. Sit-up exercises are performed in the sagittal plane of motion.

PARTIAL SQUATS (Quadriceps muscles of the legs, gluteus of the buttock, and biceps and triceps of the arm):

The user stands on the floor with the support straps secured on both legs, just above the knees, as illustrated in FIG. 12. A grip strap is looped inside each support strap. Both hands are positioned in the grip straps. The user pulls on the straps to bend the upper body at the waist then returns the body to an upright position to execute the exercise, as illustrated in FIG. 12. Partial Squat exercises are performed in the sagittal plane of motion.

FULL SQUATS (Quadriceps muscles of the legs, gluteus of the buttock, and biceps and triceps of the arm):

The user stands on the floor with the support straps secured on both legs, just below the knees, as illustrated in FIG. 13. A grip strap is looped inside each support strap. Both hands are positioned in the grip straps. The user pulls on the straps to bend the upper body at the waist then returns the body to an upright position to execute the exercise, as illustrated in FIG. 13. Full Squat exercises are performed in the sagittal plane of motion.

It will be understood by those skilled in the art that the scope of the invention is not limited by the embodiments or exercise descriptions discussed above. The invention can be changed or modified with equivalent elements or exercise positions modified, without changing its scope. The scope of the invention is defined by the following claims.

What is claimed is:

1. A wearable exercise device comprising:

at least one support strap of uniform width;

at least one grip strap of uniform width; and a 360° rotatable swivel having two rotatable ends each with a single opening; wherein the at least one support strap and the at least one grip strap are respectively and directly attached through the single openings of the rotatable ends of the 360° rotatable swivel; and wherein the wearable exercise device is configured for performing isometric and isotonic resistance exercises by a user.

2. The wearable exercise device according to claim 1, wherein the at least one support strap comprises a buckle or closure.

3. The wearable exercise device according to claim 1, wherein the at least one support strap and the at least one grip strap are independently composed of any elastic or inelastic, natural or manmade material.

4. The wearable exercise device according to claim 3, wherein the at least one support strap and the at least one grip strap are independently composed of one or more material selected from the group consisting of leather, rubber, polyethylene, polyester, polypropylene, nylon, and elastomers.

5. The wearable exercise device according to claim 1, wherein the at least one support strap comprises adjustable closures to allow for a custom fit to a hand, a wrist, a lower arm, an upper arm, a lower leg, an upper leg, an ankle, or a foot of the user.

6. The wearable exercise device according to claim 1, wherein the uniform width of the at least one support strap is smaller than the respective single opening in one of the rotatable ends of the 360° rotatable swivel.

7. The wearable exercise device according to claim 1, wherein the uniform width of the at least one grip strap is smaller than the respective single opening in one of the rotatable ends of the 360° rotatable swivel.

8. The wearable exercise device according to claim 1, wherein the at least one grip strap can move freely and without restrictions through the respective single opening in one of the rotatable ends of the 360° rotatable swivel.

* * * * *